United States Patent [19]

Chai

[11] Patent Number: 4,884,799

[45] Date of Patent: Dec. 5, 1989

[54] WALKER

[76] Inventor: Mong-Hsiang Chai, No. 41, Section 1, Ching Sha St., Tainan, Taiwan

[21] Appl. No.: 250,072

[22] Filed: Sep. 28, 1988

[51] Int. Cl.[4] ..... A61H 3/00; B62B 1/00; A47D 13/04

[52] U.S. Cl. ..... 272/70.3; 280/650; 297/5

[58] Field of Search ..... 272/70, 70.3; 280/649, 280/650, 87.02 W; 297/5

[56] References Cited

U.S. PATENT DOCUMENTS

| | | | |
|---|---|---|---|
| 4,019,756 | 4/1977 | Ishida | 280/649 |
| 4,433,869 | 2/1984 | Payne et al. | 280/650 |
| 4,576,392 | 3/1986 | Quinlan | 297/5 |
| 4,615,523 | 10/1986 | Chen | 272/70.3 |
| 4,759,541 | 7/1988 | Chen | 272/70.3 |

*Primary Examiner*—Stephen R. Crow
*Attorney, Agent, or Firm*—Morton J. Rosenberg; David I. Klein

[57] ABSTRACT

This invention is directed to an improved adjusting bracket assembly having particular application for providing a height adjustment for a baby walker. The adjusting bracket assembly includes a sliding rod, springs, a block member, a setting plate and a guide block to provide a height adjustment. By depressing the guide block, an inclined surface of the guide block will displace the sliding rod and thereby detach a pair of detents of the block member from the beveled teeth of an adjusting bracket member. With the detents detached, the adjusting bracket is then displaceable for adjusting the height of the walker.

2 Claims, 6 Drawing Sheets

WALKER

BACKGROUND OF THE INVENTION

Baby walker has long been widely adopted by users because of its convenience. However, there are some problems still exists, such as inconvenience in height adjustment and the possibility of hurting babies' fingers when they stick their fingers into the mechanism.

The inventor, in view of this, has invented this invention which simplifies the procedure of height adjustment and which utilizes two shields to prevent baby from inserting their fingers into mechanism.

SUMMARY OF THE INVENTION

It is the primary object of the present invention to provide an improved walker which is convenient in height adjustment.

It is another object of the present invention to provide an improved walker which will prevent baby from hurting their fingers.

It is still another object of the present invention to provide an improved walker which is simple in structure.

It is a further object of the present invention to provide an improved walker which is economic in manufacture.

The novel features which are characteristic of my invention are set forth in the appended claims. The invention itself, however, will best be understood by reference to the following specification, when considered in connection with the accompanying drawings.

DETAILED DESCRIPTION OF THE PREFERRED EMBODIMENT

Figure 1:
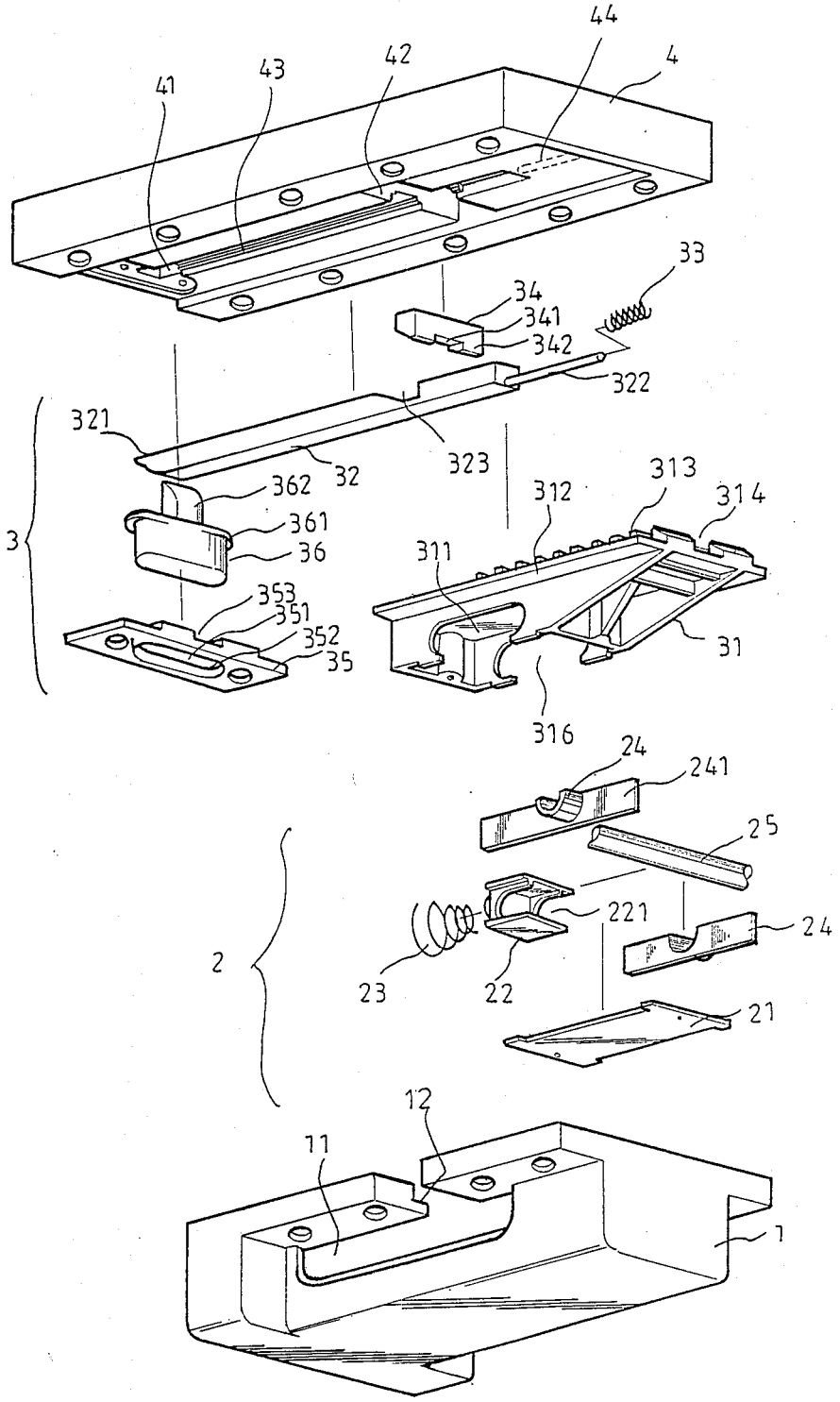
FIG. 1 is a parts breakdown view of the present invention.

FIG. 1 is a parts breakdown view of the present invention which has four sections. They are cover 1, shock absorber 2, height adjustment 3 and base 4. The cover 1 has two side throughs 11 at two sides and two inner troughs 12. The base 4 has a square trough 41, a long trough 42, a transverse trough 43 and a groove 44. The shock absorber 2 comprises a plate 21, a bracket 22, a spring 23, two shields 24 and a rod 25. The height adjustment 3 comprises an adjusting bracket 31, a sliding rod 32, a spring 33, a block 34, a setting plate 35 and a guide block 36. Said adjusting bracket 31 has two side troughs 311 at each side, two side edges 312, several bevel gears 313 and spline 314. Said sliding rod 32 has a slanting surface 321 at one end and a post 322 at other end. In the middle of the sliding rod 32, there is a sliding trough 323 for accommodating with the block 34. Said block 34 also has a slanting surface 341 and two detents 342. Said setting plate 35 has a setting trough 351, two protruding edges 352 and a ditch 353. Said guide block 36 has two side edges 361 and a tang 362.

Figure 2:
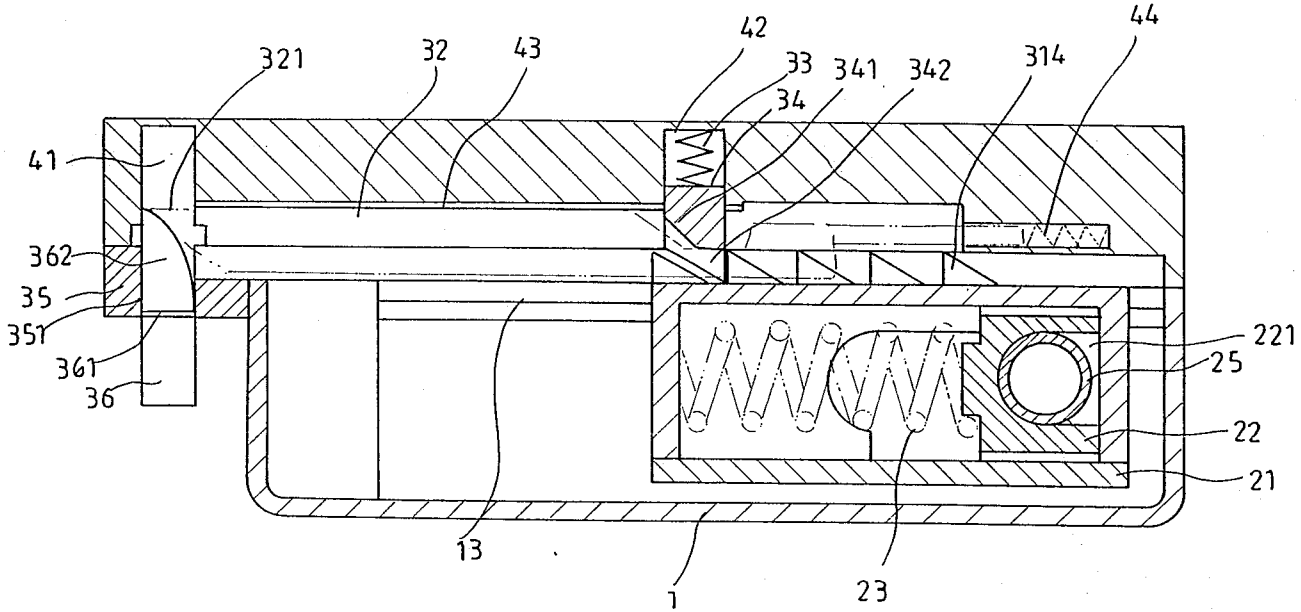
FIG. 2 is a longitudinal section view of the present invention.
Figure 3:
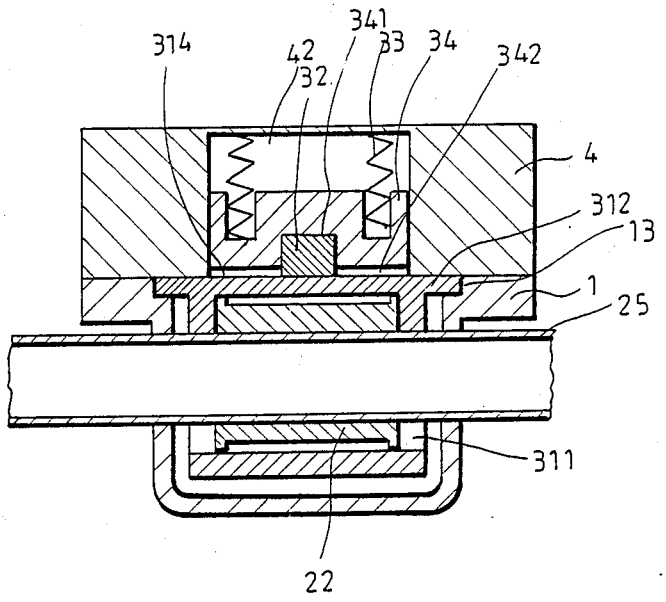
FIG. 3 is a transversal section view of the present invention.
Figure 4:
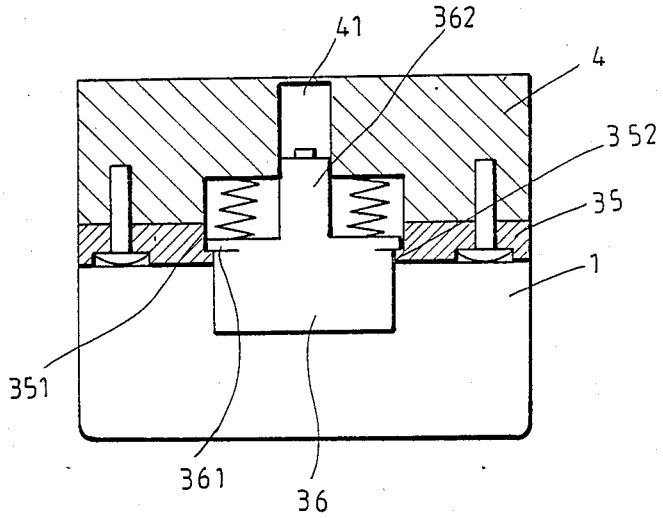
FIG. 4 is a front sectional view of the guide block of the present inventioin.

Reference now may be made to FIG. 2, 3 and 4 which catalogues into two parts. The first is shock absorber and the second is height adjustment. The chock absorber assembly method is listed as follows: insert the rod 25 into the bracket 22 and place the bracket 22 in the adjusting bracket 31 with one end of the spring 23 against the bracket 22 and other end against the inner wall of the adjusting bracket 31. Place the two shields 24 onto the rod 25 and place the plate 21 onto the adjusting bracket 31. This completes the assembled procedure of shock absorber section. The procedure of assembly height adjustment is firstly by placing the spring 33 onto the post 322 of the sliding rod 32 then place the block 34 into the long trough 42 and the sliding rod 32 into the transverse trough 43 with the post 322 in the groove 44. The slanting surface 341 of the block 43 meshes with the sliding trough 323 of the sliding rod 32. Please the guide block 36 into the square trough 41 of the base 4, then place the setting plate 35 onto the guide block 36. Thus the assembling procedure of height adjustment is done.

Upon the completion of assembling procedure of the chock absorber and the height adjustment sections, it is only necessary to place the shock absorber section onto the height adjustment section, and the detents 342 of the block 34, at this time, will mesh together with the bevel gear 313 of the adjusting bracket 31 and the sliding rod 32 will be located under the spline 314 of the adjusting bracket 31.

Figure 5:
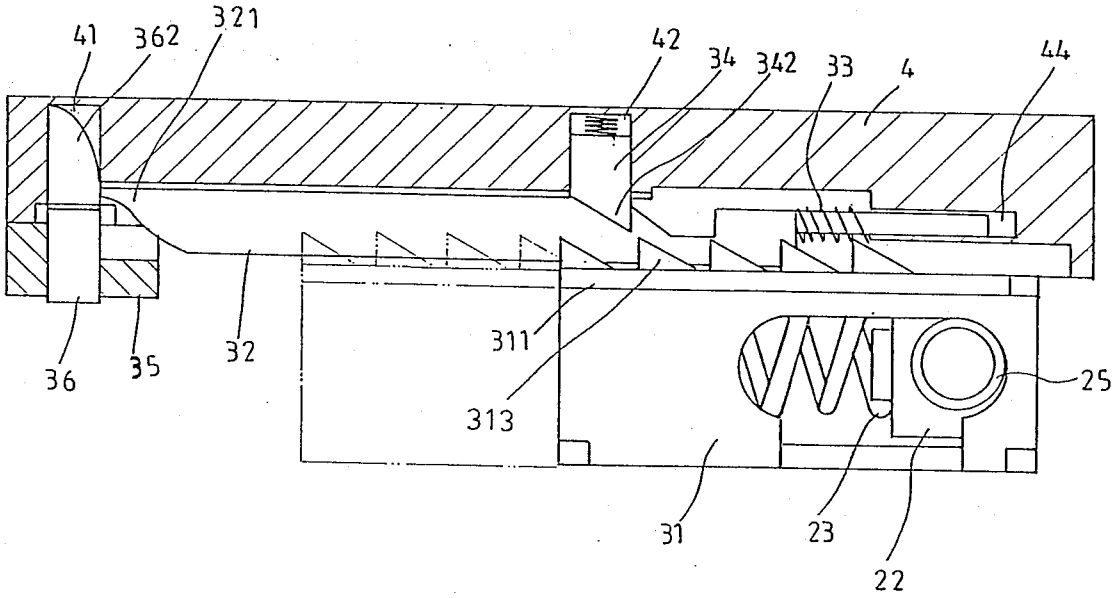
FIG. 5 is a longitudinal sectional view of the present invention showing the guide block is depressed.
Figure 6:
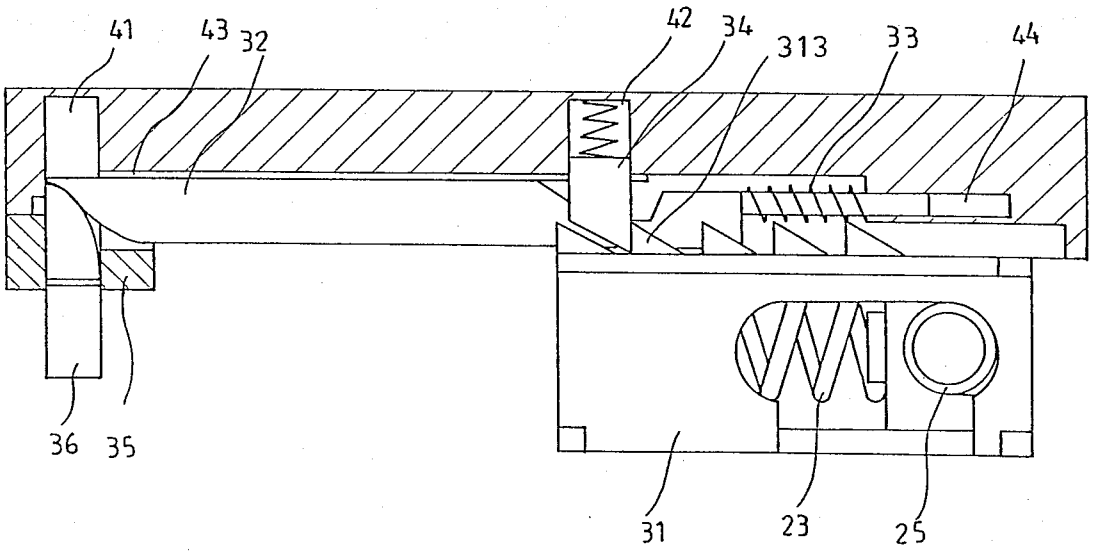
FIG. 6 is another longitudinal section view of the present invention showing the guide block at its original position.

FIG. 5 is a longitudinal section view of the present invention showing the guide block 36 is pressed upward. As can be seen the tany 362 has forced the sliding rod 32 to move toward one side which forces the block 42 to move upwardly and the dents 342 detach from the bevel gears 314, thus the height of the walker is adjustable. However, when the guide block 36 returns back to its original position shown as FIG. 6, the sliding rod 32, because of the elastic force of the spring 33, will also return to its original position, thus the block 42 dropped down and the detents 341 again meshes together with the bevel gears 314 and the walker is at fixed height position.

Figure 7:
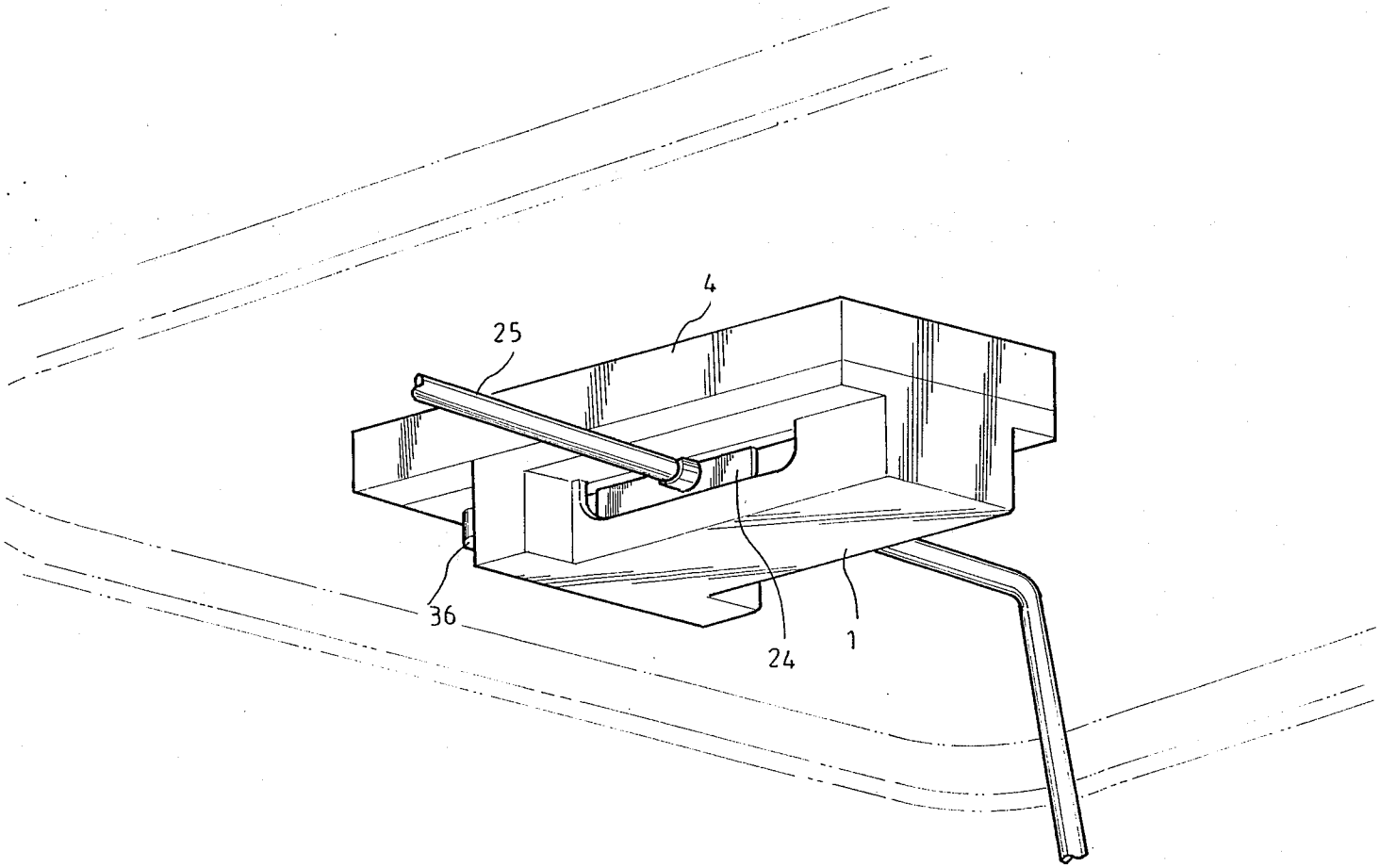
FIG. 7 is a perspective view of the present invention.

FIG. 7 is a perspective view of the present invention. From which it is realized that the two shields have covered the space tht prior art does not and reduce the posibility of hurting babies' fingers.

I claim:

1. A height adjustment mechanism for use in a baby walker, comprising:

a base member having: (1) a square shaped recess formed adjacent one end thereof, (2) a longitudinally extended recess joining said square shaped recess on a first end, (3) a transverse recess intersecting said longitudinally extended recess, and (4) a bore extending from a second end of said longitudinally extended recess;

a cover member adapted for coupling with said base member and having a pair of through openings formed on opposing sides thereof, said cover further having a pair of inner recesses wherein each of said inner recesses is formed in an inner surface of a base portion of a respective one of said opposing sides;

means for height adjustment including:

(a) a sliding rod having an inclined surface on one end and a post extending from an opposing end, said sliding rod having a portion operatively positioned within said longitudinally extended recess with said post extending into said bore formed in said base member, (b) a first bracket member having a plurality of beveled tooth-like projections extending from a base surface in two substantially parallel rows, said rows of tooth-like projections defining a first channel therebetween for receiving a portion of said sliding rod, (c) a block member positionally located within said transverse recess of said base member and being spring biased against a camming surface of said sliding rod, said block member having a pair of detents between which defines a second channel for receiving a portion of said sliding rod, each of said detents being releasably lockingly engaged with a respective one of said plurality of tooth-like projections, (d) a guide block member operatively received within said base member square shaped recess, said guide block having an inclined surface matingly interfaced with said inclined end surface of said sliding rod for displacing said sliding rod responsive to displacement of said guide block member, whereby responsive to said sliding rod displacement said block member is sufficiently displaced by said camming surface of said sliding rod to disengage said detents from said toothlike projections and thereby permit said first bracket member to be displaced relative to said base member; and, means for shock absorbing disposed within a cavity formed in said bracket member, said shock absorbing means includes a pair of shield members slidingly coupled to said height adjustment means and each having a through opening for passage of a rod member therethrough, each of said shield members providing a closure for a respective one of said cover member through openings.

2. The height adjustment mechanism as recited in claim 1 wherein said chock absorbing means further includes a second bracket member having a channel portion for receiving a portion of said rod member therein, said second bracket member being spring biased for contiguous contact with said rod member.

* * * * *